US009646781B1

(12) United States Patent
Gluchman, Jr. et al.

(10) Patent No.: US 9,646,781 B1
(45) Date of Patent: May 9, 2017

(54) PUSH BUTTON ENCODERS FOR EXERCISE EQUIPMENT

(71) Applicant: Brunswick Corporation, Lake Forest, IL (US)

(72) Inventors: Michael N. Gluchman, Jr., Chicago, IL (US); Warren A. Rickert, Glen Ellyn, IL (US); Zhi Lu, Glenview, IL (US); Bradley Holmes, Western Springs, IL (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/830,803

(22) Filed: Aug. 20, 2015

(51) Int. Cl.
*H01H 13/14* (2006.01)
*H01H 13/10* (2006.01)
*H01H 13/702* (2006.01)

(52) U.S. Cl.
CPC ..... *H01H 13/14* (2013.01); *H01H 13/10* (2013.01); *H01H 13/702* (2013.01); *H01H 2207/03* (2013.01); *H01H 2215/004* (2013.01)

(58) Field of Classification Search
CPC ..... H01H 13/14; H01H 13/48; H01H 13/52; H01H 2221/09; H01H 13/10; H01H 13/702; H01H 2207/03
USPC ..... 200/345, 341, 310, 292, 512–517
See application file for complete search history.

(56) References Cited

U.S. PATENT DOCUMENTS

| | | | | |
|---|---|---|---|---|
| 5,258,592 | A * | 11/1993 | Nishikawa | H01H 13/52 200/302.2 |
| 7,355,165 | B2 | 4/2008 | Shaw et al. | |
| 7,846,070 | B2 | 12/2010 | Oglesby et al. | |
| 9,050,498 | B2 | 6/2015 | Lu et al. | |
| 2007/0246335 | A1* | 10/2007 | Sharrah | H01H 13/503 200/1 B |
| 2014/0252883 | A1* | 9/2014 | Dinh | H01H 13/06 307/125 |
| 2015/0190671 | A1 | 7/2015 | Golen, Jr. et al. | |

* cited by examiner

*Primary Examiner* — Edwin A. Leon
*Assistant Examiner* — Ahmed Saeed
(74) *Attorney, Agent, or Firm* — Andrus Intellectual Property Law, LLP

(57) ABSTRACT

A push button encoder comprises a push button, a base that supports the push button, and a printed circuit board. Pushing the push button engages the printed circuit board and thereby causes the printed circuit board to output an electrical signal. A spring resiliently supports the printed circuit board with respect to the base such that the printed circuit board is movable with respect to the base when the push button is pushed.

16 Claims, 4 Drawing Sheets

PUSH BUTTON ENCODERS FOR EXERCISE EQUIPMENT

FIELD

The present disclosure relates to push button encoders, and in certain examples to push button encoders for exercise equipment.

BACKGROUND

The following U.S. Patents and Patent Publication are incorporated herein by reference, in entirety:

U.S. Pat. No. 7,355,165 discloses an optical encoder and a system and a method for outputting a signal. The optical encoder and the system have a shaft extending from an interior of a housing. A circuit board having a light emitting element and a light detector is connected to the housing. The light emitting element emits an amount of light within the interior of the housing. A light pipe transmits, deflects and/or directs the amount of light from the light emitting element toward the light detector. A rotor which is connected to the shaft rotates to change the amount of light received by the light detector. The shaft is connected to a sprocket which contacts a spring to produce a sound or vibration which indicates the shaft is rotating, twisting and/or turning. The circuit board outputs a signal via a cable based on the amount of light received by the light detector. The signal corresponds to a position and/or a location of the shaft.

U.S. Pat. No. 7,846,070 discloses a microprocessor-based exercise treadmill control system which includes various features to enhance user operation. These features include programs operative to: permit a set of user controls to cause the treadmill to initially operate at predetermined speeds; permit the user to design custom workouts; permit the user to switch between workout programs while the treadmill is in operation; and perform an automatic cooldown program where the duration of the cooldown is a function of the duration of the workout or the user's heart rate. The features also include a stop program responsive to a detector for automatically stopping the treadmill when a user is no longer on the treadmill and a frame tag module attached to the treadmill frame having a non-volatile memory for storing treadmill configuration, and operational and maintenance data. Another included feature is the ability to display the amount of time a user spends in a heart rate zone.

U.S. Pat. No. 9,050,498 discloses an exercise assembly having a frame and elongated foot pedal members that are each movable along user-defined paths of differing dimensions. Each foot pedal member has a front portion and a rear portion. Footpads are disposed on the rear portion of one of the pair of foot pedal members. Elongated coupler arms have a lower portion and an upper portion that is pivotally connected to the frame. Crank members have a first portion that is pivotally connected to the front portion of one of the pan of foot pedal members and have a second portion that is pivotally connected to the lower portion of one of the pair of coupler arms, such that each crank member is rotatable in a circular path. Elongated rocker arms have a lower portion that is pivotally connected to one of the pair of foot pedal members in between the foot pad and the crank member and have an upper portion that is pivotally connected to the frame.

U.S. Patent Application Publication No. 2015/0190671 discloses stair climber apparatuses having a frame having an inclined support that extends from a bottom portion to a top portion; a plurality of stairs that are connected together in series and travel in a loop around the inclined support; an electric motor; and a control circuit that controls a speed of the electric motor and an output direction of the electric motor. The electric motor is operatively connected to the plurality of stairs so as to move the plurality of stairs in an upward direction along the inclined support and so as to alternatively move the plurality of stairs in an opposite, downward direction along the inclined support. An operator input device at the bottom portion of the inclined support inputs a boarding command to the control circuit. Based on the boarding command, the control circuit controls the electric motor so as to move the plurality of stairs along the inclined support.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In certain examples, a push button encoder comprises a push button, a base that supports the push button, and a printed circuit board. Pushing the push button engages the printed circuit board and thereby causes the printed circuit board to output an electrical signal. A spring resiliently supports the printed circuit board with respect to the base such that the printed circuit board is movable with respect to the base when the push button is pushed.

BRIEF DESCRIPTION OF THE DRAWINGS

Examples of exercise equipment including strength training apparatuses are described with reference to the following drawing figures. The same numbers are used throughout the drawing figures to reference like features and components.

DETAILED DESCRIPTION OF THE DRAWINGS

Figure 1:
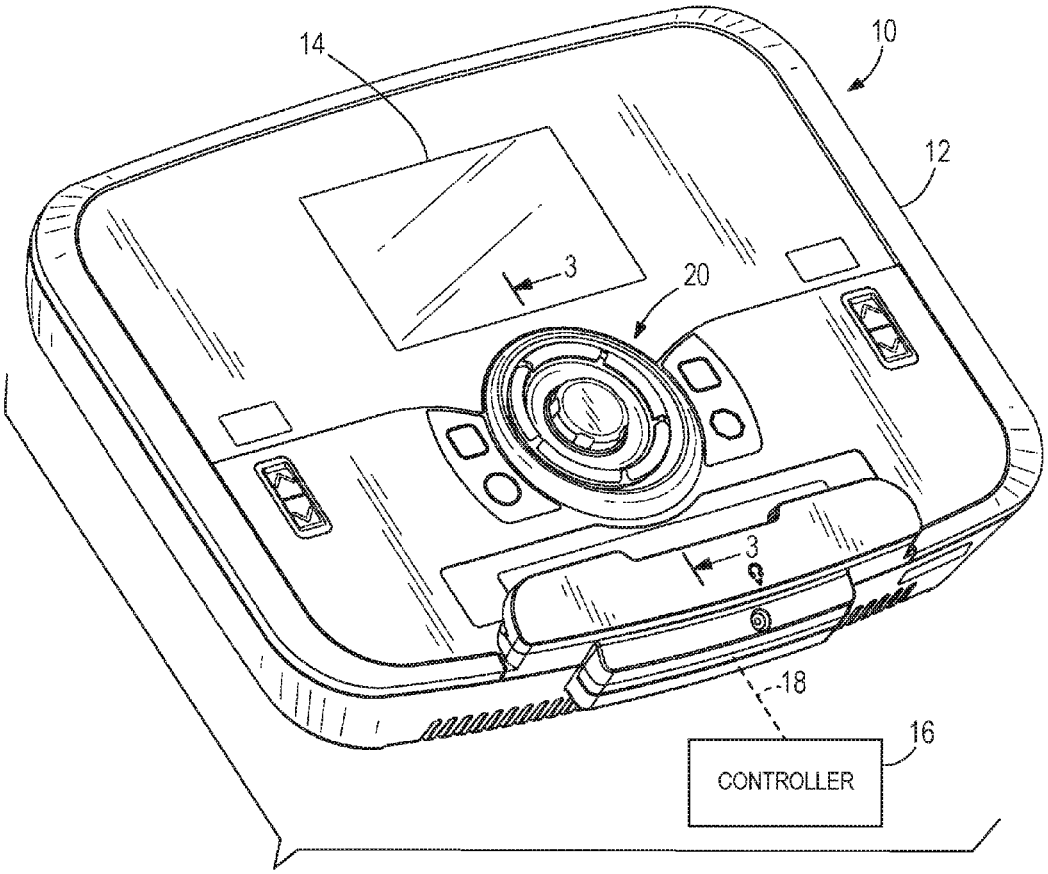
FIG. 1 is a perspective view of an exemplary input console for exercise equipment and a schematic view of a controller associated with the input console.

FIG. 1 depicts an input console 10 for use with exercise equipment, such as a treadmill, elliptical apparatus, stair climber apparatus, free motion apparatus, and/or any other type of personal or group exercise equipment. Non-limiting examples of such exercise equipment are disclosed in the above-incorporated U.S. Pat. No. 7,846,070; U.S. Pat. No. 9,050,498; and U.S. Patent Application Publication No. 2015/0190671. The input console 10 shown in FIG. 1 is exemplary and can be configured in any known manner. In the non-limiting example shown in FIG. 1, the input console 10 has a housing 12 and a display 14 for displaying one or more operational characteristics of the exercise equipment to a user. The display 14 can be a conventional LCD display, a touch receptive display, an interactive display, or any other conventional type of display. In other examples, the input console 10 can include more than one display 14. The type of operational characteristics displayed on the display 14 can vary, and for example include any one of various settings of the exercise equipment such as amounts or levels of resistance provided by the equipment, speeds or rates of operation of the equipment, exercise activities that have already been undertaken by the user(s) and/or are about to be undertaken, exercise programs or routines that have been or could be undertaken, and/or the like.

The input console 10 is in communication with a controller 16 associated with the exercise equipment via a communication link 18. The controller 16 is shown schematically in FIG. 1 and can have any conventional physical form. The communication link 18 can be wired or wireless. The controller 16 can be located in the housing 12 or remotely from the housing 12 or in both the housing 12 and remotely from the housing 12. The controller 16 includes a computing system that includes a processing system, storage system, software, and input/output (I/O) interfaces for communicating with the input console 10 and for controlling one or more functional characteristics of the exercise equipment. The processing system loads and executes software from the storage system. The computing system may include one or many application modules and one or more processors, which may be communicatively connected. The processing system can comprise a microprocessor and other circuitry that retrieves and executes software from the storage system. The processing system can be implemented within a single processing device but can also be distributed across multiple processing devices or sub-systems that cooperate in existing program instructions. Non-limiting examples of the processing system include general purpose central processing units, applications specific processors, and logic devices. The storage system can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can include additional elements, such as a controller capable of communicating with the processing system. Non-limiting examples of the storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

The controller 16 is configured to receive electrical signals from one or more input devices associated with the input console 10, including a push button encoder 20 that is the subject of the present disclosure and is further described herein below. Based upon the electrical signals, the controller 16 is configured to initiate and/or control one or more of the noted operational characteristics of the exercise equipment, as is conventional. For example, the controller 16 can be programmed to control the resistance provided by exercise equipment according to one of a plurality of exercise routines. In some examples, the controller 16 can be programmed to control the display 14 to display to the user one or more operational characteristics of the exercise equipment, for example a particular characteristic selected by the user. This type of system is known in the art and examples are provided in the incorporated U.S. Pat. No. 7,846,070 and Patent Publication No. 2015/0190671.

Figure 2:
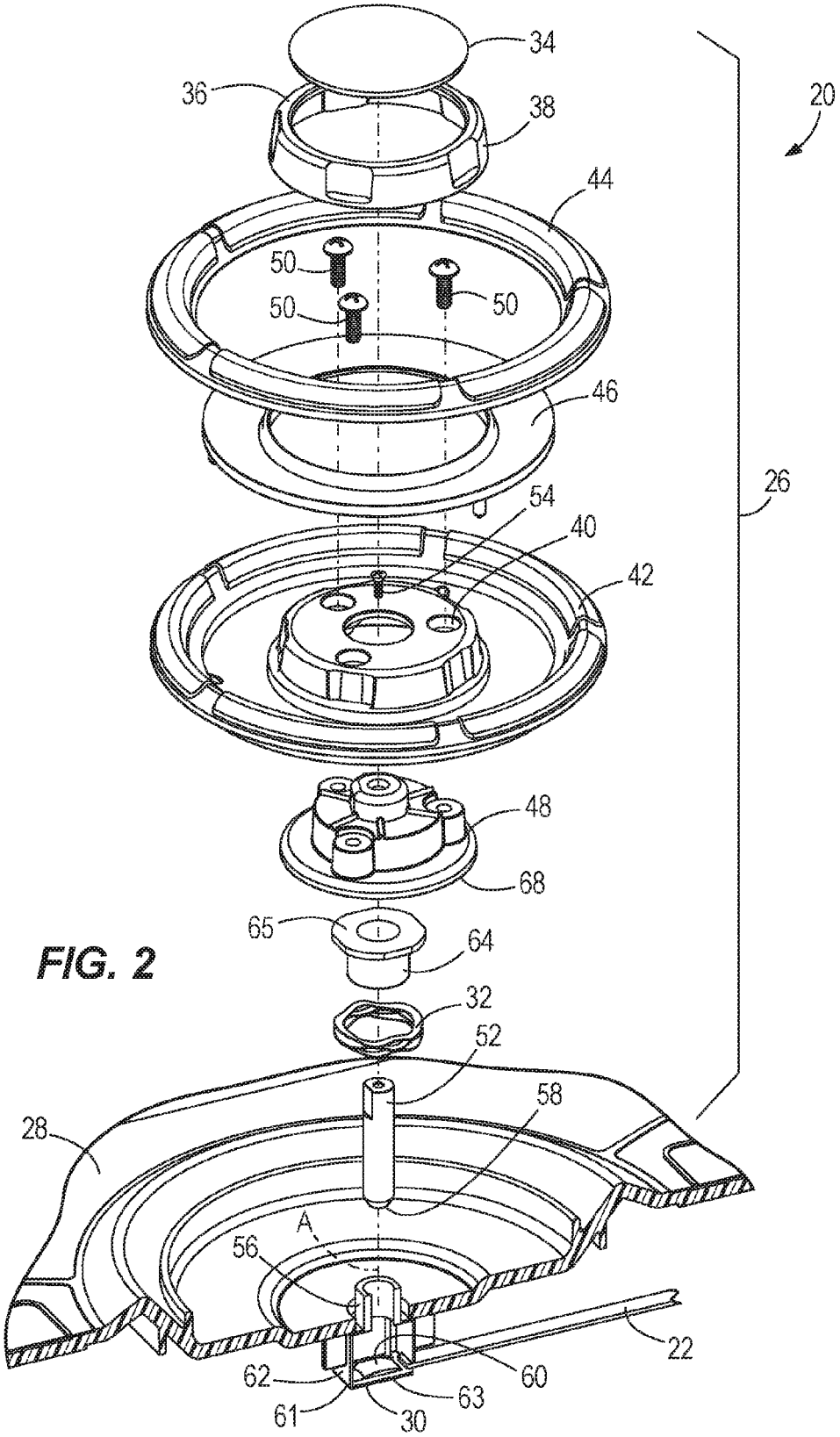
FIG. 2 is an exploded view of a push button encoder associated with the input console.

Referring to FIGS. 1 and 2, the push button encoder 20 is configured to output an electrical signal to the controller 16 via an encoder communication link 22, which can be the same as or separate from the communication link 18. The encoder communication link 22 can be wired or wireless. Based upon the electrical signal from the push button encoder 20, the controller 16 is configured to control the input console 10 and/or the exercise equipment, as is convention and described herein above.

In a non-limiting example, the push button encoder 20 is rotatable about its center axis A and also translatable back and forth along the center axis A. In certain examples, rotation of the push button encoder 20 about the center axis A causes the push button encoder 20 to output an electrical signal that causes the controller 16 to control the display 14 to highlight different ones of a plurality of operational characteristics in a menu or other type of list on the display 14. Such rotary functionality of push button encoders is well-known in the art. One example of such rotary action for a push button encoder is disclosed in the incorporated U.S. Pat. No. 7,355,165. In certain examples, the push button encoder 20 can include an optical encoder 24, shown schematically in FIGS. 3 and 4 and is configured to sense rotation of the push button encoder 20 about the center axis A and output an electrical signal to the controller 16. In certain examples the optical encoder 24 functions independently of other push button functionality, including translation of the push button encoder 20 along the center axis A, as will be further described herein below. However this is a non-limiting example and it is not essential that the push button encoder 20 be rotatable and the push button encoder 20 can operate in conjunction with other functionalities of the input console 10 and/or the display 14.

In the illustrated example, actuating the push button encoder 20, via for example manually pushing the push button encoder 20 and thus causing the push button encoder 20 to translate along axis A, outputs an electrical signal via the encoder communication link 22, which causes the controller 16 to select one of the operational characteristics shown on the display 14. Thus the push button encoder 20 and the display 14 provide a means for the user to view of a plurality of operational characteristics of the exercise equipment and then manually select one or more of the operational characteristics for the controller 16 act upon.

FIG. 2 depicts an exploded view of a non-limiting example of a push button encoder 20 according to the present disclosure. In this example, the push button encoder 20 includes a push button 26, a base 28 that supports the push button 26, and a printed circuit board 30. As described further herein below, pushing the push button 26 engages the printed circuit board 30 and thereby causes the printed circuit board 30 to output an electrical signal to the controller 16 via the communication link 18. Such printed circuit board functionality is known in the art and one example is described in the above-incorporated U.S. Pat. No. 7,355,165. Also, according to the present disclosure, and as further described herein below, the push button encoder 20 includes at least one spring 32 that resiliently supports the printed circuit board 30 with respect to the base 28 such that the printed circuit board 30 is movable with respect to the base 28 when the push button 26 is pushed.

The configuration of the push button 26 can vary from that which is shown. In the illustrated example, the push button 26 includes a top plate 34 that resides in a radially inner top groove 36 of a center ring 38. The center ring 38 rests on top of a center column 40 of a flexible lower push button ring 42. A radially outer cover ring 44 and a flexible inner ring 46 top surfaces of the lower push button ring 42. Both the radially outer cover ring 44 and flexible inner ring 46 circumferentially surround the center column 40 of the lower push button ring 42. A retainer 48 is fixed to the lower surface of the center column 40 by a plurality of fasteners 50. An input shaft 52 is connected to the lower surface of the retainer 48 by a connector 54. The input shaft 52 extends through a center hole 56 in the base 28. The lower free end 58 of the input shaft 52 is configured to engage with the printed circuit board 30 via a dome switch 60 that is disposed between the input shaft 52 and the printed circuit board 30. The printed circuit board 30 is contained within a housing 62 that extends through the base 28. The base 28 is slideable back and forth with respect to the base 28, as shown by comparison of FIGS. 3 and 4. The housing 62 includes a body 61 and a top bushing 64 which can be separately formed and/or connected to the body 61 and/or integrally formed with the body 61. In this example, the spring 32 includes a plurality of wave springs that are disposed around the input shaft 52 and between the housing 62 and base 28 and more particularly between a flange 65 on the top bushing 64 and the upper surface of the base 28 around the center hole 56.

During research and experimentation, the present inventors have determined that conventional push button encoders are sometimes damaged when a user presses down too hard on the push button, causing it to impinge against a printed circuit board that is fixed to the base. As such, the present inventors endeavored to provide an improved push button encoder configuration that prevents or at least limits such damage to the printed circuit board. Through research and experimentation, the present inventors conceived of the presently disclosed push button encoder 20 having at least one spring 32 that resiliently supports the printed circuit board 30 with respect to the base 28 when the push button 26 is pushed. This advantageously prevents or at least limits damage to the printed circuit board 30 when the user presses down hard on the push button 26.

Figure 3:
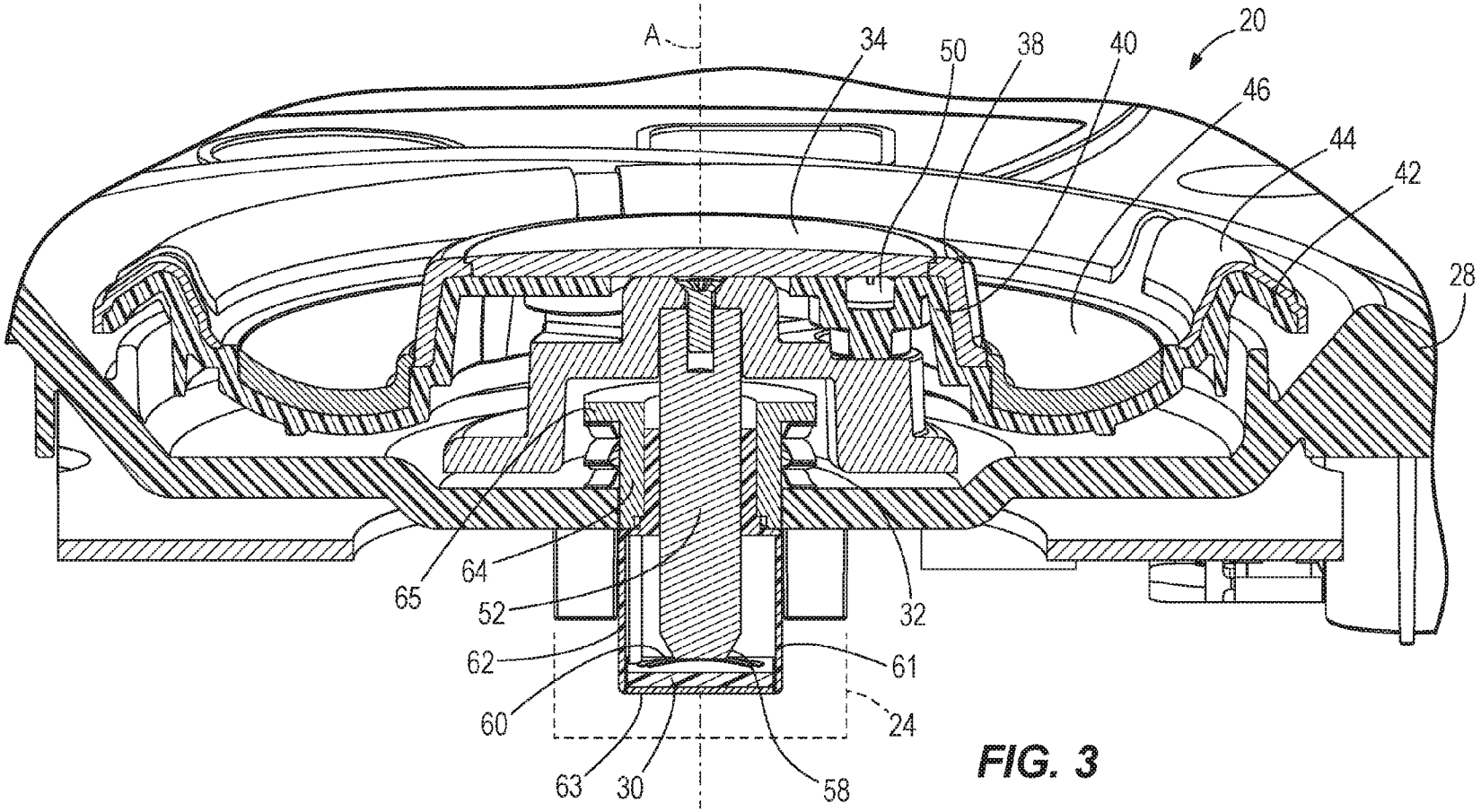
FIG. 3 a side sectional view of the push button encoder in an inactive position.
Figure 4:
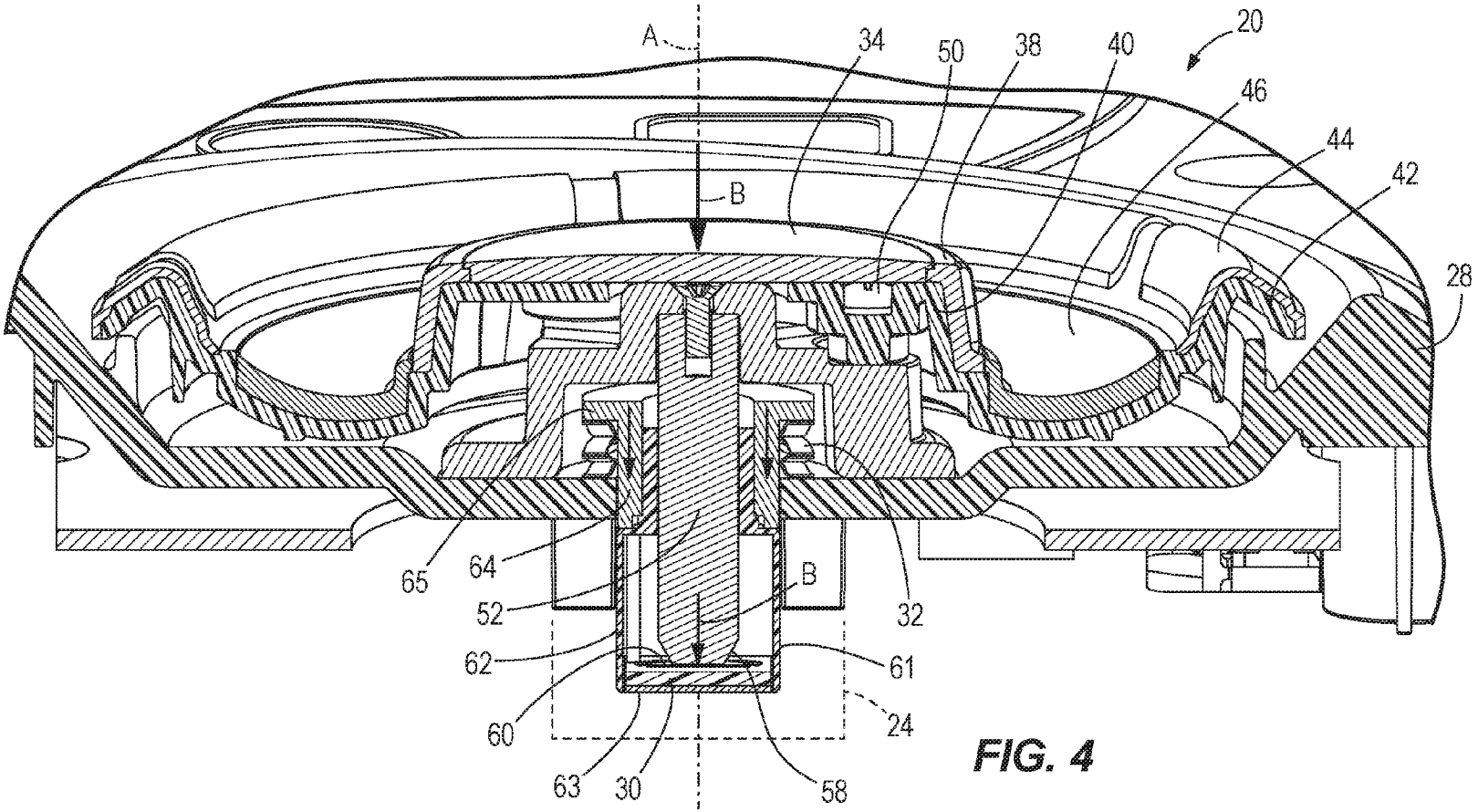
FIG. 4 is a side sectional view of the push button encoder in an active position.

FIG. 3 depicts the push button encoder 20 in an inactive position, wherein the push button 26 is not being pressed by the user. FIG. 4 depicts the push button encoder 20 in an active position, wherein the push button 26 is being pushed by the user. As can be seen by comparison of FIGS. 3 and 4, pushing the push button 26 moves the printed circuit board 30 in a first direction B, with respect to the base 28. As can be seen from comparison of FIGS. 4 and 3, releasing the push button 26 causes the spring 32 to spring the printed circuit board 30 back in an opposite, second direction (i.e. opposite B), with respect to the base 28. In this example, the noted first direction B is away from the base 28 and the noted second direction is towards the base 28; however this is not limiting and the first and second directions could be oppositely oriented with respect to this example.

The manner in which the spring 32 and printed circuit board 30 are interconnected can vary from the illustrated example. The type of spring 32 can also vary from that which is shown. In the illustrated example, the spring 32 and printed circuit board 30 are interconnected via the housing 62, which as discussed herein above, houses the printed circuit board 30. The housing has a bottom wall 63 that supports the printed circuit board and the top flange 65, which in this example is provided by the top bushing 64. The top flange 65 and bottom wall 63 are disposed on opposite sides of the base 28. The housing 62 is disposed in the center hole 56 of the base 28 and is movable, in this example slideable back and forth, with respect to the base 28 when the push button 26 is manually pushed. The spring 32 has a top side (i.e. a first end) that acts on the housing 62 via the noted top bushing 64 and a bottom side (i.e. a second end) that acts on the base 28. In this example, the top and bottom sides abut the top flange 65 and base 28, respectively. As shown in FIGS. 3 and 4, the spring 32 is thus disposed in between the housing 62 and the base 28 and also disposed around the housing 62, i.e. around the top bushing 64. The illustrated example includes wave springs, however the type of spring can vary from that which is shown and can include a coil spring, tension spring, and/or the like. As shown by comparing FIGS. 3 and 4, the housing 62 is slideable with respect to the base 28 in the noted first and second directions, which in this example are away from the base 28 and towards the base 28, respectively.

As mentioned herein above, the configuration of the push button 26 can vary from that which is shown. The illustrated example includes the input shaft 52, wherein pushing the push button 26 moves the input shaft 52 into engagement with the printed circuit board 30 and causes the printed circuit board 30 to output the electrical signal via the communication link 18. The input shaft 52 has a free end 58 that moves towards and away from the bottom wall 63 when the push button 26 is pushed and released, respectively. The retainer 48 has a lower flange 68 that abuts the base 28 when the push button 26 is pushed and that is spaced apart from the base 28 when the push button 26 is released. The dome switch 60 is disposed between the input shaft 52 and the printed circuit board 30 such that pushing the push button 26 collapses the dome switch 60 against the printed circuit board 30 and causes the printed circuit board 30 to output the electrical signal to the controller 16. Further pushing the push button 26 causes the housing 62 carrying the printed circuit board 30 to slide in the direction B and compresses the spring 32 until the lower flange 68 of the retainer 48 abuts the base 28. Releasing the push button 26 allows the natural resiliency of the dome switch 60 to spring back away from or apart from the printed circuit board 30 into the position shown in FIG. 3, and simultaneously allows the spring 36 to naturally, resiliently extend, pushing the top flange 65 away from the base 28, thus pushing the housing 62, printed circuit board 30, and push button 26 back into the position shown in FIG. 3.

It will thus be seen that the present disclosure provides an input console 10 for exercise equipment that comprises the console 12 and the push button encoder 20 described herein above. The present disclosure further discloses an improved push button encoder 20 having an actuator 26, a base 28 that supports the actuator 26, a printed circuit board 30 and a spring 32 that resiliently supports the printed circuit board 30 with respect to the base 28 such that the printed circuit board 30 is movable with respect to the base 28 when the actuator 26 is actuated. The actuator 26 moves the printed circuit board 30 in the first direction B with respect to the base 28. The spring 32 causes the printed circuit board 30 to spring back in the opposite, second direction with respect to the base 28.

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

What is claimed is:

1. A push button encoder, comprising:

a push button;

a base that supports the push button;

a printed circuit board;

wherein pushing the push button in a first direction engages the printed circuit board and thereby causes the printed circuit board to output an electrical signal;

a spring that resiliently supports the printed circuit board with respect to the base such that further pushing the push button moves the printed circuit board in the first direction with respect to the base; wherein the spring causes the printed circuit board to move in an opposite, second direction when the push button is released; and a housing that houses the printed circuit board, wherein the housing is movable in the first direction with respect to the base when the push button is further pushed and movable in the opposite, second direction when the push button is released.

2. The push button encoder according to claim 1, wherein releasing the push button causes the spring to spring the printed circuit board back in the opposite, second direction with respect to the base.

3. The push button encoder according to claim 2, wherein the first direction is away from the base and the opposite, second direction is towards the base.

4. The push button encoder according to claim 1, wherein the spring has a first end that acts on the housing and a second end that acts on the base.

5. The push button encoder according to claim 4, wherein the spring is disposed in between the housing and the base.

6. The push button encoder according to claim 5, wherein the spring is disposed around the housing.

7. The push button encoder according to claim 6, wherein the spring comprises at least one wave spring.

8. The push button encoder according to claim 4, wherein the housing extends through the base and is slideable with respect to the base the first direction away from the base and the second opposite, direction towards the base.

9. A push button encoder, comprising:

a push button;

a base that supports the push button;

a printed circuit board;

wherein pushing the push button in a first direction engages the printed circuit board and thereby causes the printed circuit board to output an electrical signal;

a spring that resiliently supports the printed circuit board with respect to the base such that further pushing the push button moves the printed circuit board in the first direction with respect to the base and in an opposite, second direction when the push button is released;

wherein the push button comprises an input shaft, wherein pushing the push button in the first direction moves the input shaft into engagement with the printed circuit board and causes the printed circuit board to output the electric signal; and a housing that houses the printed circuit board, wherein the housing is movable with respect to the base in the first direction when the push button is pushed and in the opposite, second direction when the push button is released, and wherein the input shaft extends through the base.

10. The push button encoder according to claim 9, wherein the input shaft extends into the housing.

11. The push button encoder according to claim 10, wherein the housing comprises a bottom wall that supports the printed circuit board and a top flange, wherein the top flange and bottom wall are disposed on opposite sides of the base.

12. The push button encoder according to claim 11, wherein the spring comprises a first end that acts on the top flange of the housing and a second end that acts on the base.

13. The push button encoder according to claim 11, wherein the input shaft has a free end that moves towards and away from the bottom wall when the push button is pushed and released respectively.

14. The push button encoder according to claim 9, further comprising a dome switch disposed between the input shaft and the printed circuit board, wherein pushing the push button collapses the dome switch against the printed circuit board such that the printed circuit board outputs the electrical signal and wherein releasing the push bottom allows the dome switch to spring back apart from the printed circuit board.

15. A push button encoder, comprising:

a push button;

a base that supports the push button;

a printed circuit board;

wherein pushing the push button engages the printed circuit board and thereby causes the printed circuit board to output an electrical signal; and a spring that resiliently supports the printed circuit board with respect to the base such that the printed circuit board is movable with respect to the base when the push button is pushed;

wherein the push button comprises an input shaft, wherein pushing the push button moves the input shaft into engagement with the printed circuit board and causes the printed circuit board to output the electric signal; and a retainer disposed between the push button and the input shaft, wherein the retainer comprises a lower flange that abuts the base when push button is pushed.

16. An input console for exercise equipment, the input console comprising a console housing and a push button encoder on the console housing, the push button encoder comprising a push button, a base that supports the push button, a printed circuit board, wherein pushing the push button in a first direction engages the printed circuit board and thereby causes the printed circuit board to output an electrical signal, and a spring that resiliently supports the printed circuit board with respect to the base such that the printed circuit board is movable in the first direction with respect to the base when the push button is further pushed and in an opposite, second direction when the push button is released; and a housing that houses the printed circuit board, wherein the housing is movable in the first direction with respect to the base when the push button is further pushed and in the opposite, second direction when the push button is released.

* * * * *